US008182249B2

(12) United States Patent
Sugimoto et al.

(10) Patent No.: US 8,182,249 B2
(45) Date of Patent: May 22, 2012

(54) SEALED TYPE SCROLL COMPRESSOR

(75) Inventors: Kazuyoshi Sugimoto, Gunma-ken (JP); Yoshiaki Koike, Ota (JP); Yasuo Sakamoto, Gunma-ken (JP)

(73) Assignee: Sanyo Electric Co., Ltd., Moriguchi-shi (JP)

( * ) Notice: Subject to any disclaimer, the term of this patent is extended or adjusted under 35 U.S.C. 154(b) by 307 days.

(21) Appl. No.: 12/405,553

(22) Filed: Mar. 17, 2009

(65) Prior Publication Data

US 2009/0246056 A1 Oct. 1, 2009

(30) Foreign Application Priority Data

Mar. 25, 2008 (JP) ..... 2008-78447

(51) Int. Cl.
*F03C 2/00* (2006.01)
*F03C 4/00* (2006.01)
*F04C 2/00* (2006.01)

(52) U.S. Cl. ..... 418/55.5; 418/55.4; 418/57; 418/104; 418/144

(58) Field of Classification Search ..... 418/55.1–55.6, 418/57, 94, 104, 144
See application file for complete search history.

(56) References Cited

U.S. PATENT DOCUMENTS

| | | | | |
|---|---|---|---|---|
| 6,146,119 | A | 11/2000 | Bush | |
| 7,611,344 | B2 * | 11/2009 | Ni | 418/55.5 |
| 2005/0152802 | A1 * | 7/2005 | Kim et al. | 418/55.5 |
| 2006/0263225 | A1 * | 11/2006 | Ueda et al. | 418/55.5 |

FOREIGN PATENT DOCUMENTS

| | | | | |
|---|---|---|---|---|
| CN | 1598316 | | 3/2005 | |
| CN | 1865705 | | 11/2006 | |
| JP | 05149267 | A * | 6/1993 | 418/55.5 |
| JP | 2004108339 | A * | 4/2004 | |
| JP | 2008-038749 | | 2/2008 | |

OTHER PUBLICATIONS

Office Action dated May 19, 2010 corresponding to Chinese patent application No. 200910118284.3 with English translation.

* cited by examiner

*Primary Examiner* — Theresa Trieu
(74) *Attorney, Agent, or Firm* — Kratz, Quintos & Hanson, LLP

(57) ABSTRACT

There is disclosed a sealed type scroll compressor which decreases a sliding loss between a thrust ring and a orbit scroll and improves the efficiency of the sealed type scroll compressor while preventing the leakage of a refrigerant between a fixed scroll and the orbit scroll, and the compressor provides a relation of F1<F2, in which F1 is an operating pressure applied from the front surface space of the thrust ring to the thrust ring, and F2 is an operating pressure applied from a back surface space to the thrust ring.

3 Claims, 6 Drawing Sheets

SEALED TYPE SCROLL COMPRESSOR

BACKGROUND OF THE INVENTION

The present invention relates to a sealed type scroll compressor including a compression element having a fixed scroll and a orbit scroll in a sealed container.

Heretofore, this type of scroll compressor includes a compression element having a fixed scroll and a orbit scroll in a sealed container, and a motor element which drives the orbit scroll. The fixed scroll is provided with a spiral groove formed by providing a spiral lap protruding from the end face of the fixed scroll. The orbit scroll similarly has a spiral lap protruding from the end face of the orbit scroll. While this lap is positioned in the groove of the fixed scroll, a plurality of compression chambers are formed on the inner peripheral side and the outer peripheral side of the lap.

Moreover, when the orbit scroll is revolved, the compression chambers are moved to the center, and the volumes of the chambers are decreased to compress a refrigerant.

In such a scroll compressor, to prevent the leakage of the refrigerant from each compression chamber formed by the orbit scroll and the fixed scroll and realize an efficient operation, it is important to decrease a gap between the fixed scroll and the orbit scroll. Therefore, a thrust ring is provided on the back surface of the orbit scroll, and the compressed refrigerant in a compression element is guided into a back surface space of the thrust ring while the compression element compresses the refrigerant to press the orbit scroll onto the fixed scroll, thereby suppressing the leakage of the refrigerant between both the scrolls (e.g., see U.S. Pat. No. 6,146,119 (Patent Document 1)).

However, a problem has occurred that the thrust ring for pressing the orbit scroll onto the fixed scroll has an excessively strong pressing force and becomes worn or that a sliding loss between the thrust ring and the orbit scroll increases.

The present invention has been developed to solve such a conventional technical problem, and an object thereof is to decrease the sliding loss between the thrust ring and the orbit scroll and improve the efficiency of a sealed type scroll compressor, while preventing the leakage of the refrigerant between the fixed scroll and the orbit scroll.

SUMMARY OF THE INVENTION

A sealed type scroll compressor according to a first aspect of the present invention comprises: a compression element having a fixed scroll and a orbit scroll; and a motor element which drives the orbit scroll being in the orbit by its axis, a structure for supporting movably the orbit scroll in the axial direction, guiding a compressed refrigerant in a compression element into a back surface space of a thrust ring provided on the back surface of the orbit scroll, and pressing the orbit scroll onto the fixed scroll by the thrust ring while the compression element compresses the refrigerant, characterized in that the compressed refrigerant in the compression element is guided into a front surface space of the thrust ring, the front surface space is positioned between the back surface of the orbit scroll and the thrust ring, to provide a relation of $F1<F2$, in which F1 is an operating pressure applied from the front surface space of the thrust ring to the thrust ring, and F2 is an operating pressure applied from the back surface space to the thrust ring.

In the sealed type scroll compressor according to a second aspect of the present invention, the present invention of the first aspect further comprises: a support member which supports the thrust ring; a ring groove formed in this support member to receive the thrust ring; back surface side seal members provided on the inner peripheral edge and the outer peripheral edge of the thrust ring to seal a portion between this thrust ring and the ring groove; and front surface side seal members provided on the inner peripheral side and the outer peripheral side of the surface of the thrust ring on the side of the orbit scroll to seal a portion between the thrust ring and the back surface of the orbit scroll, characterized in that a relation of $A1>A2$ is provided, in which A1 is the surface area of the thrust ring between the back surface side seal members corresponding to the back surface space of the thrust ring, and A2 is the surface area of the thrust ring between the front surface side seal members corresponding to the front surface space of the thrust ring.

The sealed type scroll compressor according to a third aspect of the present invention is characterized in that in the second aspect of the present invention, the compressed refrigerant in the compression element having a pressure higher than that of the compressed refrigerant in the compression element to be guided into the back surface space is guided into the front surface space of the thrust ring in a range of the relation of $F1<F2$, in which F1 is the operating pressure applied from the front surface space of the thrust ring to the thrust ring, and F2 is the operating pressure applied from the back surface space to the thrust ring.

According to the first aspect of the present invention, in the sealed type scroll compressor comprising the compression element having the fixed scroll and the orbit scroll; and the motor element which drives the orbit scroll being in the orbit by its axis, the structure for supporting movably the orbit scroll in the axial direction, guiding the compressed refrigerant in the compression element into the back surface space of the thrust ring provided on the back surface of the orbit scroll, and pressing the orbit scroll onto the fixed scroll by the thrust ring while the compression element compresses the refrigerant, the compressed refrigerant in the compression element is guided into the front surface space of the thrust ring, the front surface space is positioned between the back surface of the orbit scroll and the thrust ring, to provide the relation of $F1<F2$, in which F1 is the operating pressure applied from the front surface space of the thrust ring to the thrust ring, and F2 is the operating pressure applied from the back surface space to the thrust ring. In consequence, while securing a sufficient pressure for pressing the orbit scroll onto the fixed scroll, it is possible to suppress a disadvantage that the thrust ring is pressed onto the orbit scroll more strongly than necessary.

Consequently, while preventing the leakage of the refrigerant between the fixed scroll and the orbit scroll, a sliding loss between the thrust ring and the orbit scroll can be decreased.

In particular, as in the second aspect of the present invention, the sealed type scroll compressor further comprises the support member which supports the thrust ring, the ring groove formed in this support member to receive the thrust ring, the back surface side seal members provided on the inner peripheral edge and the outer peripheral edge of the thrust ring to seal the portion between this thrust ring and the ring groove, and the front surface side seal members provided on the inner peripheral side and the outer peripheral side of the surface of the thrust ring on the side of the orbit scroll to seal the portion between the thrust ring and the back surface of the orbit scroll. The relation of $A1>A2$ is provided, in which A1 is the surface area of the thrust ring between the back surface side seal members corresponding to the back surface space of the thrust ring, and A2 is the surface area of the thrust ring between the front surface side seal members corresponding to the front surface space of the thrust ring. In this case, when the same compressed refrigerant in the compression element is simply guided into the front surface space of the thrust ring and the back surface space of the thrust ring, the operating pressure F1 applied from the front surface space of the thrust ring to the thrust ring and the operating pressure F2 applied from the back surface space to the thrust ring can have the relation of F1<F2.

In consequence, a structure for guiding the pressure can be simplified.

Moreover, as in the third aspect of the present invention, the compressed refrigerant in the compression element having the pressure higher than that of the compressed refrigerant in the compression element to be guided into the back surface space is guided into the front surface space of the thrust ring in the range of the relation of F1<F2, in which F1 is the operating pressure applied from the front surface space of the thrust ring to the thrust ring, and F2 is the operating pressure applied from the back surface space to the thrust ring. In this case, the operating pressure F1 applied from the front surface space to the thrust ring can be brought close to the operating pressure F2 applied from the back surface space to the thrust ring.

In consequence, while keeping the function of pressing the orbit scroll onto the fixed scroll without any trouble, the sliding loss between the thrust ring and the orbit scroll can be minimized.

In general, the efficiency of the sealed type scroll compressor can be improved.

DESCRIPTION OF THE PREFERRED EMBODIMENT

According to the present invention, in a sealed type scroll compressor, a thrust ring is provided on the back surface of a orbit scroll to press the orbit scroll onto a fixed scroll, and a compressed refrigerant in a compression element is guided into a back surface space of this thrust ring to press the orbit scroll onto the fixed scroll, thereby suppressing the leakage of the refrigerant between both the scrolls. In this case, the present invention is developed to eliminate a disadvantage that a pressure from the thrust ring in such a direction as to press the orbit scroll onto the fixed scroll is excessively strongly exerted to increase a sliding loss between the thrust ring and the orbit scroll. Such an object to decrease the sliding loss between the thrust ring and the orbit scroll while preventing the leakage of the refrigerant between the fixed scroll and the orbit scroll is realized by providing a relation of F1<F2, in which F1 is an operating pressure applied from the front surface space of the thrust ring to the thrust ring, and F2 is an operating pressure applied from the back surface space to the thrust ring. Hereinafter, embodiments of the present invention will be described with reference to the drawings.

Embodiment 1

Figure 1:
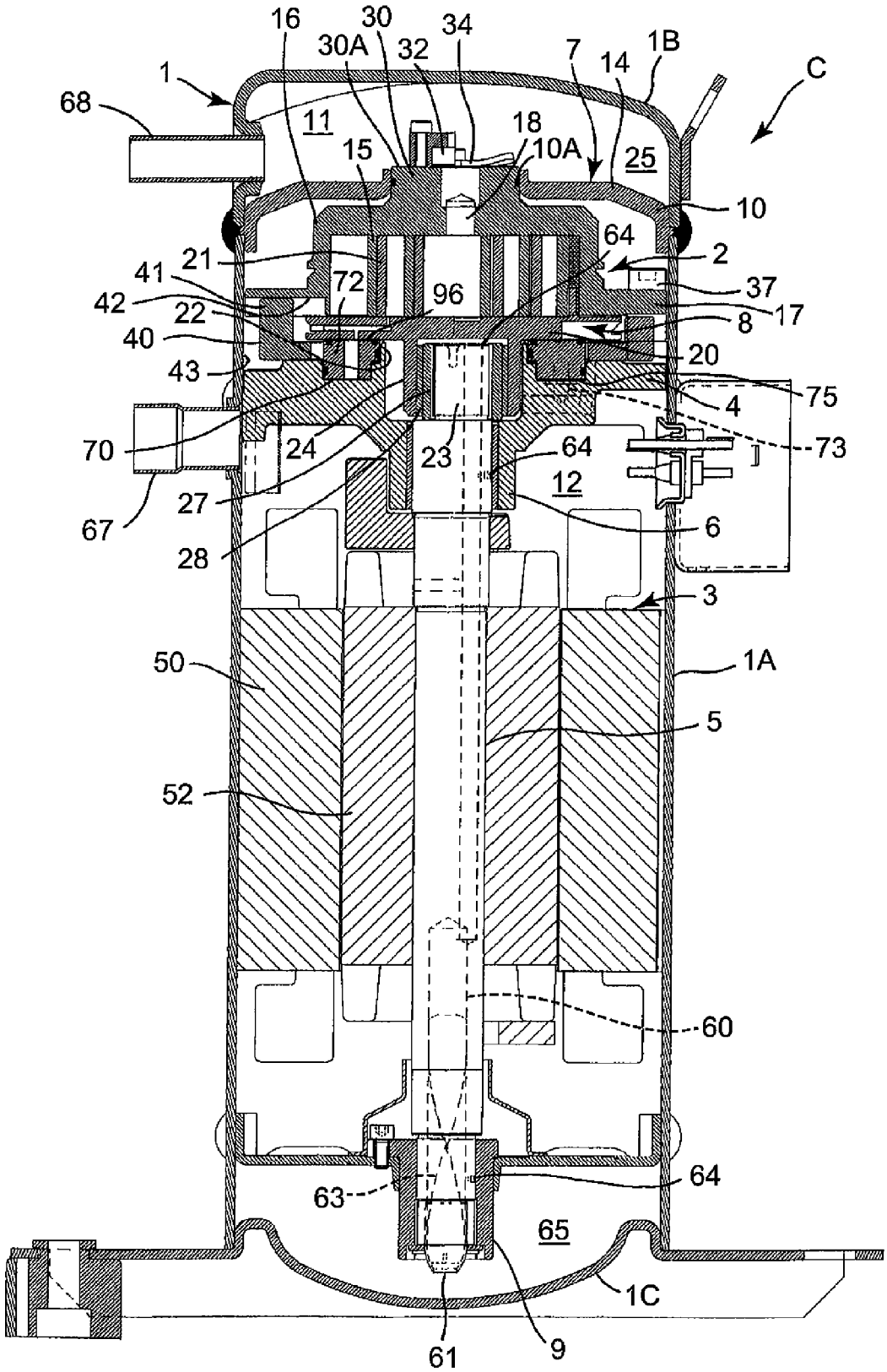
FIG. 1 is a vertical side view of a first embodiment of a sealed type scroll compressor to which the present invention is applied (Embodiment 1)
Figure 2:
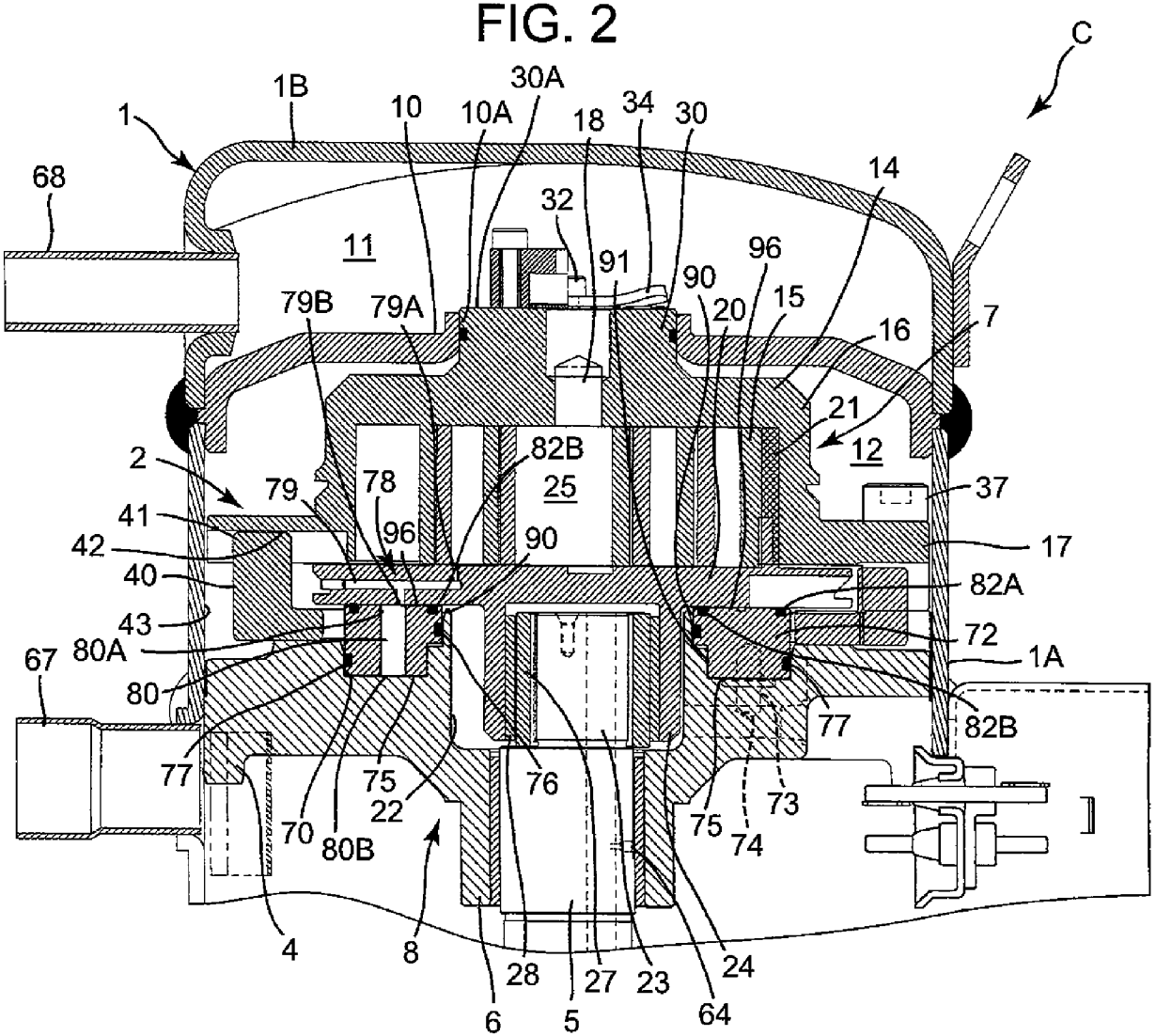
FIG. 2 is an enlarged view around a compression element of the sealed type scroll compressor of FIG. 1.

FIG. 1 shows a vertical side view of one embodiment of a sealed type scroll compressor to which the present invention is applied, and FIG. 2 shows a partially enlarged view of FIG. 1, respectively. In the drawing, reference numeral 1 is a sealed container. This sealed container 1 is constituted of a container main body 1A having a vertically long cylindrical shape, and an end cap 1B and a bottom cap 1C fixedly welded to both ends (both of upper and lower ends) of this container main body 1A and each substantially having a bowl-like shape.

Moreover, on the upside in this sealed container 1 is provided a partition plate 10 which vertically partitions a space in the sealed container 1. That is, the inside of the sealed container 1 is partitioned into an upper space 11 and a lower space 12 by the partition plate 10.

In the lower space 12 of the sealed container 1 are received a compression element 2 on the upside and a motor element 3, as driving means for driving this compression element 2, on the downside. Moreover, a bottom portion (i.e., the inner surface of the bottom cap 1C) 65 of the space 12 is an oil reservoir in which a lubricant for lubricating the compression element 2 and the like is received. A support frame 4 is received between this compression element 2 and the motor element 3 in the sealed container 1, and this support frame 4 is provided with a bearing 6 and a boss receiving portion 22 in the center of the support frame. This bearing 6 supports the tip (the upper end) of a shaft (axis) 5, and is formed to protrude downwards from the center of one surface (the lower surface) of the support frame 4. Moreover, the boss receiving portion 22 receives a boss 24 of a orbit scroll 8 described later, and is formed by recessing downwards the center of the other surface (the upper surface) of the support frame 4.

Moreover, the tip (the upper end) of the shaft 5 is provided with an eccentric shaft 23. The center of this eccentric shaft 23 is provided to deviate from the center of the shaft 5, and this eccentric shaft is drivably and turnably inserted into the boss 24 through a slide bush 27 and a shaft receiver 28.

The compression element 2 is constituted of a fixed scroll 7 and the orbit scroll 8. The fixed scroll 7 is constituted of a disc-like mirror plate 14, a spiral lap 15 vertically provided on one surface (the lower surface) of this mirror plate 14 and having an involute shape or a curved shape approximated to this involute shape, a peripheral wall 16 vertically provided so as to surround the periphery of this lap 15, and a flange 17 provided around this peripheral wall 16 and having the outer peripheral edge thereof burned and fitted into the inner surface of the container main body 1A of the sealed container 1. The center of the mirror plate 14 of the fixed scroll 7 is provided with a discharge hole 18 which communicates with the upper space 11 of the sealed container 1 partitioned by the partition plate 10. Moreover, the lap 15 protrudes downwards in the fixed scroll 7.

In the constitution of the present embodiment, the mirror plate 14 of the fixed scroll 7 includes a cylindrical protruding portion 30 protruding from the other surface (the upper surface) of the mirror plate 14 and having the discharge hole 18. Moreover, this protruding portion 30 fits in a holding hole 10A formed in the partition plate 10, and an upper surface 30A of the protruding portion 30 is opposed to the upper space 11 of the partition plate 10. The upper surface 30A of the protruding portion 30 is provided with a discharge valve 32 which opens/closes the discharge hole 18, and a plurality of release valves 34 disposed adjacent to the discharge valve 32. The release valves 34 are provided to prevent the excessive compression of the refrigerant, and connected to a compression space 25 of a compression process described later through a release port (not shown).

Specifically, when the refrigerant pressure of the compression process reaches a discharge pressure before reaching the discharge hole 18, the release valves 34 are opened to discharge the refrigerant from the compression space 25 through the release port.

On the other hand, the orbit scroll 8 is constituted of a disc-like mirror plate 20, a spiral lap 21 vertically provided on one surface (the upper surface) of this mirror plate 20 and having an involute shape or a curved shape approximated to this involute shape, and the boss 24 protruding from the center of the other surface (the lower surface) of the mirror plate 20. Moreover, in the orbit scroll 8, the lap 21 protrudes upwards, this lap 21 is arranged so that when the lap is turned as much as 180 degrees, the lap faces and engages with the lap 15 of the fixed scroll 7, and a plurality of compression spaces 25 are formed between the inner laps 15 and 21.

That is, the lap 21 of the orbit scroll 8 faces the lap 15 of the fixed scroll 7, and the tip surfaces of both the laps 21, 15 engage with each other so that the tip surface of one of the laps comes in contact with the bottom surface of the other lap. Moreover, the orbit scroll 8 is fitted into the eccentric shaft 23 provided to deviate from the shaft center of the shaft 5. Therefore, the two spiral laps 21, 15 are mutually eccentrically disposed, and come in contact with each other along the eccentric direction to form a plurality of sealed spaces 25, so that the respective spaces 25 form compression chambers.

In the fixed scroll 7, the flange 17 provided around the peripheral wall 16 of the fixed scroll is fixed to the support frame 4 via a plurality of bolts 37. Moreover, the orbit scroll 8 is supported by the support frame 4 via an Oldham's ring 40. This Oldham's ring 40 revolves the orbit scroll 8 along a circular orbit so that the orbit scroll does not rotate itself with respect to the fixed scroll 7, and includes a pair of Oldham's keys 41, 41 formed to protrude upwards at facing positions.

These Oldham's keys 41, 41 slidably engage with a key groove 42 formed in the lower surface of the fixed scroll 7. In this case, when the orbit scroll revolves, the Oldham's ring 40 slides along the extending direction of the Oldham's keys 41 in a sliding space 43 formed between the fixed scroll 7 and the support frame 4.

Furthermore, the orbit scroll 8 revolves eccentrically with respect to the fixed scroll 7. Therefore, eccentric directions and the contact positions of the two spiral laps move while rotating, and the compression chamber is reduced while moving from the outer compression space 25 to the inner compression space. First, a low-pressure refrigerant gas enters the outer compression space, is confined, and moves inwards while being insulated and compressed. Finally, when the gas reaches the center, the gas forms a high-temperature high-pressure refrigerant gas. This refrigerant gas is fed to the space 11 through the discharge hole 18 provided in the center.

On the other hand, the motor element 3 is constituted of a stator 50 fixed to the sealed container 1, and a rotor 52 arranged on the inner side of the stator 50 to rotate in the stator 50. The shaft 5 is fitted into the center of the rotor 52. The terminal end (the lower end) of the shaft 5 is supported by a bearing 9 arranged in the bottom portion of the sealed container 1.

Moreover, in the shaft 5, an oil path 60 is formed along the axial direction of the shaft 5. This oil path 60 includes a suction port 61 positioned at the lower end of the shaft 5, and a paddle 63 formed above the suction port 61. The lower end of the shaft 5 is immersed into the lubricant received in the oil reservoir 65, and the suction port 61 of the oil path 60 opens in the lubricant. Furthermore, an oil supply port 64 for supplying the lubricant is formed at a position corresponding to each bearing in the oil path 60. According to such a constitution, when the shaft 5 rotates, the lubricant received in the oil reservoir 65 enters the oil path 60 from the suction port 61 of the shaft 5, and is pumped up along the paddle 63 of the oil path 60. In addition, the pumped-up lubricant is supplied to each bearing or a sliding portion of the compression element 2 through each oil supply port 64 or the like.

On the other hand, the sealed container 1 is provided with a refrigerant introduction tube 67 for introducing the refrigerant into the lower space 12 of the sealed container 1, and a refrigerant discharge tube 68 for discharging, to the outside, the refrigerant discharged into the upper space 11 of the sealed container 1. In the present embodiment, the refrigerant introduction tube 67 is fixedly welded to the side surface of the container main body 1A of the sealed container 1, and the refrigerant discharge tube 68 is fixedly welded to the side surface of the end cap 1B.

FIG. 2 is an enlarged view of a portion around the compression element 2. As shown in FIG. 2, in the upper surface of the support frame 4, an annular ring groove 70 is formed in the periphery of the boss receiving portion 22, and a thrust ring 72 formed of an iron-based sintered member is arranged in the ring groove 70. The thrust ring 72 supports the mirror plate 20 of the orbit scroll 8, and decreases a sliding resistance between the orbit scroll 8 and the support frame 4 during the moving of the orbit scroll 8. A positioning pin 73 is protruded from the lower surface of the thrust ring 72, and the positioning pin 73 is inserted into an engagement hole 74 provided in the ring groove 70. Therefore, even when the orbit scroll 8 revolves above the thrust ring 72, the thrust ring 72 is positioned by the support frame 4 while the rotation of the thrust ring 72 is stopped by the positioning pin 73.

Moreover, according to the constitution of the present embodiment, the orbit scroll 8 is supported movably in the axial direction toward the fixed scroll 7. When the compressed refrigerant in the compression element 2 (the refrigerant in the compression process by the compression element 2 is guided into the lower surface (the back surface) of the thrust ring 72 while the compression element 2 compresses the refrigerant, the orbit scroll 8 can be pressed onto the fixed scroll 7 via the thrust ring 72.

Specifically, a back surface space 75 into which the compressed refrigerant in the compression element 2 is guided is formed between the thrust ring 72 and the support frame 4. Moreover, at the inner peripheral edge and the outer peripheral edge of the thrust ring 72, O-rings (back surface side seal members) 76, 77 for securing the air tightness of the back surface space 75 are arranged, respectively. Moreover, the orbit scroll 8 and the thrust ring 72 are provided with a communication hole 78 which connects the compression space 25 to the back surface space 75. This communication hole 78 is constituted of a first communication hole 79 formed in the orbit scroll 8 and a second communication hole 80 formed in the thrust ring 72.

The first communication hole 79 is formed to extend in the radial direction of the mirror plate 20 of the orbit scroll 8, and includes an upper surface port 79A in the upper surface (the lap face) of the mirror plate 20, and a lower surface port 79B in the lower surface (the back surface) of the mirror plate 20. The upper surface port 79A is positioned at a position which communicates with the compression space 25 having the intermediate pressure, and this intermediate pressure is set to a value closer to a suction pressure.

On the other hand, the second communication hole 80 is a through hole extending through the thrust ring 72 in an axial center direction (the vertical direction), and includes an upper surface port 80A formed in the upper surface of the thrust ring 72 and a lower opening 80B formed in the lower surface of the thrust ring 72 and connected to the back surface space 75. In the constitution of the present embodiment, the upper surface port 80A of the second communication hole 80 is formed at a position including the turning track of the lower surface port 79B so that when the orbit scroll 8 is revolved, the lower surface port 79B of the first communication hole 79 formed in the orbit scroll 8 constantly communicates with the upper surface port 80A of the second communication hole 80 formed in the thrust ring 72. Therefore, while the compression element 2 compresses the refrigerant, the intermediate pressure of the compression space 25 can constantly be guided into the back surface space 75, and the orbit scroll 8 can stably be pressed onto the fixed scroll 7 via the thrust ring 72.

Moreover, even if dust or the like is generated in the compression space 25 and this dust or the like is guided together with the refrigerant into the first communication hole 79, the lower surface port 79B of the first communication hole 79 is present on the inner side of the upper surface port 80A of the second communication hole 80, and hence the dust or the like does not enter the sliding face between the thrust ring 72 and the orbit scroll 8. In consequence, it is possible to prevent the increase of the sliding resistance between the orbit scroll 8 and the thrust ring 72 during the moving of the orbit scroll 8 or a disadvantage that the sliding face is damaged by the dust or the like.

Figure 3:
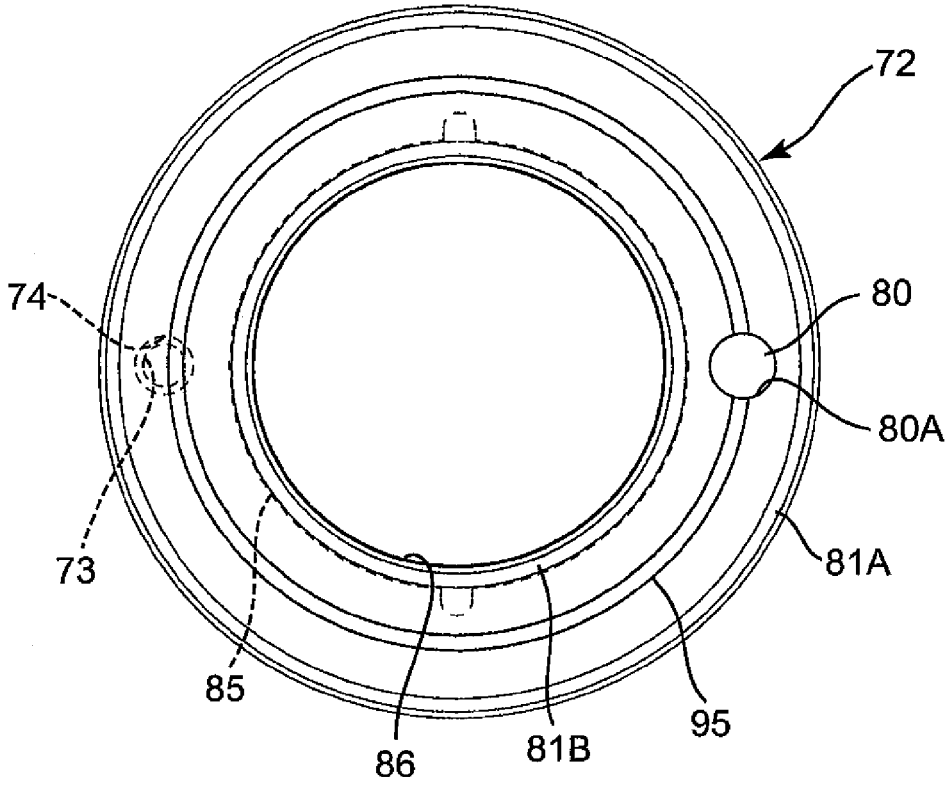
FIG. 3 is a plan view of a thrust ring of the sealed type scroll compressor of FIG. 1.

Furthermore, in the upper surface of the thrust ring 72, as shown in FIG. 3, annular grooves 81A, 81B are formed on the outer peripheral side and the inner peripheral side of the upper surface port 80A of the second communication hole 80, respectively, and seal members (front surface side seal members) 82A, 82B (FIG. 2) excellent in wear resistance are arranged in the respective grooves 81A, 81B. The seal members 82A, 82B prevent the refrigerant guided from the compression space 25 to the first communication hole 79 from being discharged to a space (e.g., the boss receiving portion 22) other than the back surface space 75 through the sliding face between the thrust ring 72 and the orbit scroll 8.

Figure 4:
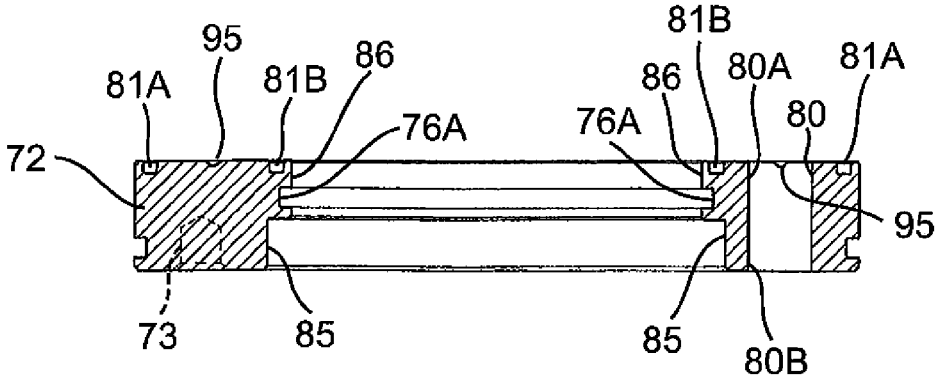
FIG. 4 is a vertical side view of the thrust ring of FIG. 3.
Figure 5:
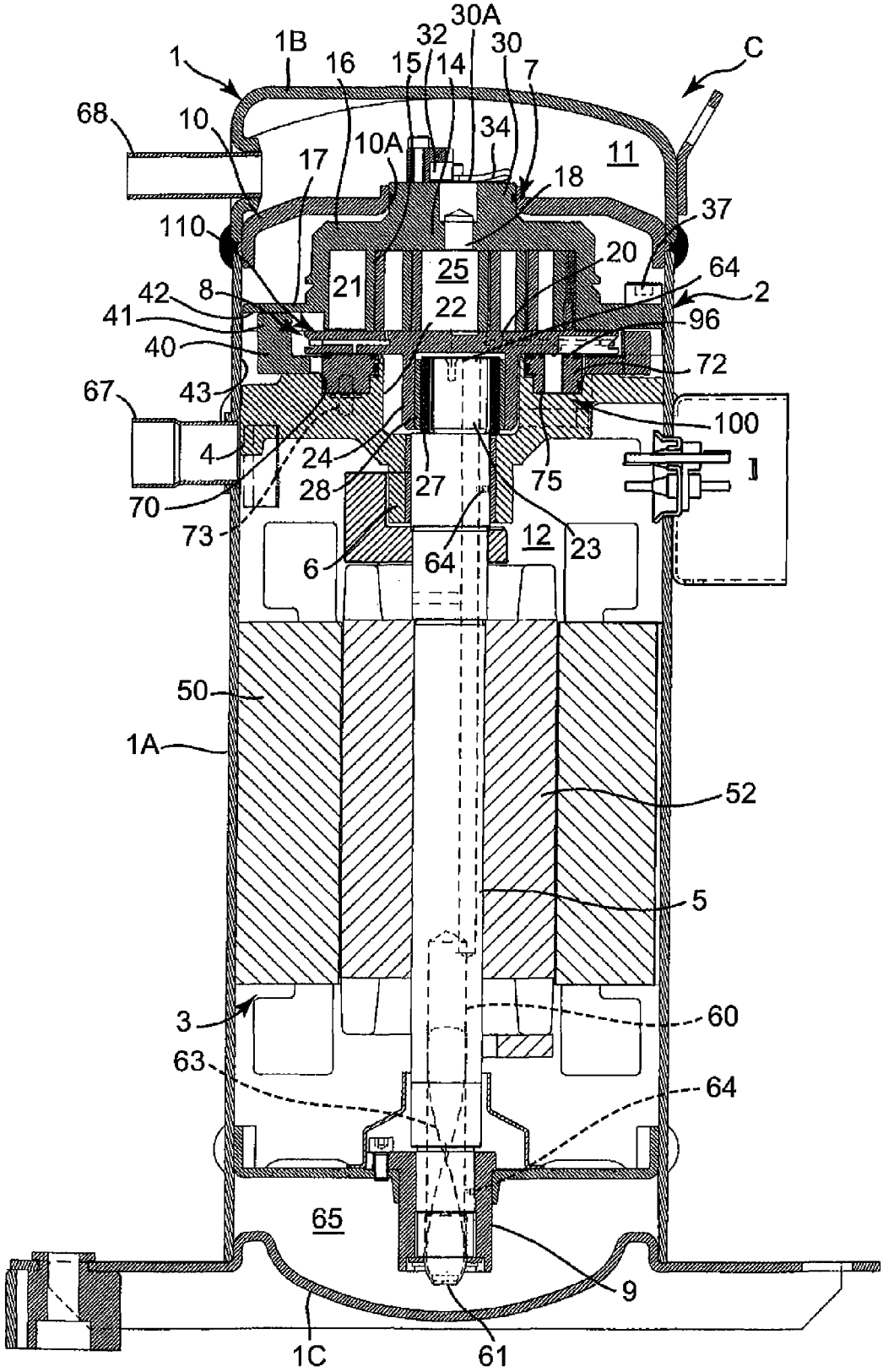
FIG. 5 is a vertical side view of a sealed type scroll compressor of another embodiment to which the present invention is applied (Embodiment 2)

In consequence, even when a force to reverse the orbit scroll 8 is generated during the moving of the orbit scroll 8, the seal members 82A, 82B can prevent the refrigerant fed from the compression space 25 to the first communication hole 79 from flowing into the boss receiving portion 22 through the sliding face between the thrust ring 72 and the orbit scroll 8. Therefore, it is possible to prevent a disadvantage that the intermediate-pressure refrigerant which has flowed into the boss receiving portion 22 flows into the oil path 60 to disturb the supply of the lubricant.

on the other hand, the inner peripheral edge and the outer peripheral edge of the thrust ring 72 are provided with the O-rings 76, 77, respectively, and air tightness between the thrust ring 72 and the ring groove 70 of the support frame 4 is secured via these O-rings 76, 77. In the present embodiment, the O-ring 76 provided at the inner peripheral edge of the thrust ring 72 is arranged at a position higher than that of the O-ring 77 provided at the outer peripheral edge. Specifically, as shown in FIG. 4, the inner peripheral edge of the thrust ring 72 is provided with a lower stepped portion 85, and an upper stepped portion 86 protruding inwardly from the lower stepped portion 85. The upper stepped portion 86 is provided with an annular groove 76A for attaching the O-ring 76, and the O-ring 76 is arranged in the groove 76A. On the other hand, the lower portion of the outer peripheral edge of the thrust ring 72 is provided with an annular groove 77A for attaching the O-ring 77, and the O-ring 77 is arranged in the groove 77A.

Furthermore, as shown in FIG. 2, the upper portion of the outer peripheral edge of the thrust ring 72 is constituted to protrude upwards from the ring groove, and this upper portion functions as an inner wall of the sliding space 43 of the Oldham's ring 40. Thus, when the O-ring 76 provided at the inner peripheral edge of the thrust ring 72 is arranged at the position higher than the O-ring 77 provided at the outer peripheral edge, the upper portion of the outer peripheral edge can be used as the inner wall of the sliding space 43 of the Oldham's ring 40, and the space can effectively be utilized. In consequence, the device can be miniaturized.

Meanwhile, when the air tightness is usually secured via the O-rings, gaps for crushing and interposing the O-rings need to be provided between the inner peripheral edge and the outer peripheral edge of the thrust ring and the inner wall and the outer wall of the ring groove, respectively. However, since the gaps are provided, the thrust ring comes apart from the ring groove, the thrust ring tilts in the ring groove, and hence any uniform pressing pressure is not exerted to the orbit scroll. When the orbit scroll tilts in this manner, the refrigerant leaks from the compression space between the orbit scroll and the fixed scroll, and the cooling efficiency of the sealed type scroll compressor might lower.

When the thrust ring 72 is arranged in the ring groove 70 of the support frame 4 to prevent this problem, the inner wall of the ring groove 70 is provided with a seal face (a seal portion) 90 facing the upper stepped portion 86 of the inner peripheral edge of the thrust ring 72 via the O-ring 76, and a guide face (a guide portion) 91 faucet-fitted (e.g., loose fit) into the lower stepped portion 85 of the thrust ring 72.

Moreover, a small gap is formed between the upper stepped portion 86 of the inner peripheral edge of the thrust ring 72 and the seal face 90 of the inner wall of the ring groove 70, and the O-ring 76 is interposed in this gap. On the other hand, the lower stepped portion 85 of the inner peripheral edge of the thrust ring 72 is faucet-fitted into the guide face 91 of the inner wall of the ring groove 70, and the thrust ring 72 is slidably provided along the guide face 91 in the ring groove 70.

Thus, since the lower stepped portion 85 of the inner peripheral edge of the thrust ring 72 is faucet-fitted into the guide face 91 of the inner wall of the ring groove 70, the lower stepped portion 85 does not come apart from the guide face 91. Therefore, when the refrigerant is guided into the back surface space 75 to slide the thrust ring 72 along the guide face 91 of the ring groove 70 in the vertical direction, the thrust ring 72 is prevented from tilting in the ring groove 70. Therefore, when the uniform pressing pressure is exerted to the orbit scroll 8 via the thrust ring 72, the tilting of the orbit scroll 8 is prevented, and hence the orbit scroll 8 comes in close contact with the fixed scroll 7. In consequence, the refrigerant leakage from the compression space 25 formed between the orbit scroll 8 and the fixed scroll 7 is suppressed, and the cooling efficiency of a sealed type scroll compressor C can be improved.

Here, as the constitution in which the thrust ring 72 does not tilt but slides along the guide groove, a constitution is considered in which a guide pin is vertically disposed in a guide groove, and extended through a thrust ring. However, according to such a constitution, the positional precision of the vertically disposed guide pin is demanded, which causes a problem that processing becomes difficult. On the other hand, in the above constitution of the present embodiment, precision may be required for faucet-fitting the lower stepped portion 85 of the inner wall of the ring groove 70 into the inner peripheral edge of the thrust ring 72. In particular, it is comparatively easy to exert a high processing precision in the processing of a peripheral surface, which produces an effect that the processing can be facilitated as compared with a case where the guide pin is vertically disposed.

Furthermore, in the ring groove 70 in which the thrust ring 72 is arranged, the seal face 90 which abuts on the O-ring 76 is disposed above the guide face 91. Therefore, the air tightness between the thrust ring 72 and the ring groove 70 can sufficiently be secured, and additionally the thrust ring 72 can stably be moved in the vertical direction. Moreover, in the present embodiment, since the thrust ring 72 is formed of the iron-based sintered member, the processing is facilitated as compared with a case where a fleckless iron-based material is cut and processed.

Meanwhile, in the scroll compressor having a function of guiding the compressed refrigerant in the compression element into the back surface space of the thrust ring provided on the back surface of the orbit scroll to press the orbit scroll onto the fixed scroll via the thrust ring, a problem has occurred that the pressing pressure of the thrust ring to press the orbit scroll onto the fixed scroll is excessively strong to wear the thrust ring or that a sliding loss between the thrust ring and the orbit scroll increases.

To solve the problem, in the present invention, the compressed refrigerant in the compression element is guided into a front surface space of the thrust ring 72 positioned between the back surface of the orbit scroll 8 and the thrust ring 72. Specifically, in the present embodiment, as shown in FIG. 3, the upper surface (the front surface) of the thrust ring 72 is provided with an annular groove 95 which communicates with the communication hole 78 for guiding the compressed refrigerant in the compression element 2 into the back surface space 75, and a part of the compressed refrigerant in the compression element 2 to be guided into the back surface space 75 can be guided from the groove to a front surface space 96 of the thrust ring 72. This groove 95 is formed at a position between the outer groove 81A and the inner groove 81B for inserting the seal members 82A, 82B, the position being connected to the second communication hole 80 of the communication hole 78. According to such a constitution, while the compression element 2 compresses the refrigerant, when the intermediate pressure of the compression space 25 is guided into the back surface space 75 through the communication hole 78, the intermediate pressure is similarly guided into the upper surface (the front surface) of the thrust ring 72 through the groove 95. In consequence, the intermediate pressure can be guided into the front surface space 96 of the thrust ring 72.

In this case, a relation of F1<F2 is set, in which F1 is an operating pressure applied from the front surface space 96 of the thrust ring 72 to the thrust ring 72, and F2 is an operating pressure applied from the back surface space 75 to the thrust ring 72. In the present embodiment, a relation of A1>A2 is provided, in which A1 is the surface area of the thrust ring 72 between the O-rings 76 and 77 on the back surface side corresponding to the back surface space 75, and A2 is the surface area of the thrust ring 72 between the seal members 82A and 82B on the front surface side corresponding to the front surface space. That is, the surface area A1 of the thrust ring 72 corresponding to the back surface side of the O-rings 76, 77 of the thrust ring 72 is larger than the surface area A2 of the thrust ring 72 from the inner peripheral side of the seal member 82A to the outer peripheral side of the seal member 82B.

Thus, the surface area A1 of the thrust ring 72 between the O-rings 76 and 77 on the back surface side corresponding to the back surface space 75 is larger than the surface area A2 of the thrust ring 72 between the seal members 82A and 82B on the front surface side corresponding to the front surface space 96. In this case, even when the refrigerants having an equal pressure are guided into both the spaces 75 and 96, the operating pressure F2 applied from the back surface space 75 to the thrust ring 72 can be larger than the operating pressure F1 applied from the front surface space 96 of the thrust ring 72 to the thrust ring 72.

That is, even when the refrigerants having an equal intermediate pressure are guided into the back surface space 75 and the front surface space 96 as in the present embodiment, the operating pressure F2 applied from the back surface space 75 to the thrust ring 72 can be larger than the operating pressure F1 applied from the front surface space 96 of the thrust ring 72 to the thrust ring 72.

Thus, the compressed refrigerant in the compression element 2 is guided into the front surface space 96 of the thrust ring 72 positioned between the back surface of the orbit scroll 8 and the thrust ring 72, and the operating pressure F1 applied from the front surface space of the thrust ring to the thrust ring 72 and the operating pressure F2 applied from the back surface space 75 to the thrust ring 72 have a relation of F1<F2. In consequence, while suppressing a disadvantage that the thrust ring 72 is pressed onto the orbit scroll 8 more strongly than necessary, the orbit scroll 8 can stably be pressed onto the fixed scroll 7 via the thrust ring 72. Therefore, while preventing the leakage of the refrigerant between the fixed scroll 7 and the orbit scroll 8, the sliding loss between the thrust ring 72 and the orbit scroll 8 can be decreased.

In particular, the surface area A1 of the thrust ring 72 between the O-rings 76 and 77 on the back surface side corresponding to the back surface space 75 is larger than the surface area A2 of the thrust ring 72 between the seal members 82A and 82B on the front surface side corresponding to the front surface space 96. In this case, even when the refrigerants of the same compression process are merely guided into the front surface space 96 of the thrust ring 72 and the back surface space 75 of the thrust ring, the operating pressure F1 applied from the front surface space 96 of the thrust ring 72 to the thrust ring 72 and the operating pressure F2 applied from the back surface space 75 to the thrust ring 72 can have the relation of F1<F2.

That is, when the compressed refrigerant in the compression element 2 is guided into the front surface space 96 of the thrust ring 72 by use of the communication hole 78 for guiding the compressed refrigerant in the compression element 2 into the back surface space 75 of the thrust ring 72, the orbit scroll 8 can stably be pressed onto the fixed scroll 7 while suppressing the disadvantage that the thrust ring 72 is pressed onto the orbit scroll 8 more strongly than necessary. In consequence, a passage for guiding the compressed refrigerant in the compression element 2 into the back surface space 75 of the thrust ring 72 can also serve as a passage for guiding the compressed refrigerant in the compression element 2 into the front surface space 96 of the thrust ring 72, so that a structure for guiding the pressure can be simplified. In general, the efficiency of the sealed type scroll compressor C can be improved.

Embodiment 2

It is to be noted that in Embodiment 1 described above, the compressed refrigerant in the compression element 2 is guided into the front surface space 96 of the thrust ring 72 by use of the communication hole 78 for guiding the compressed refrigerant in the compression element 2 into the back surface space 75 of the thrust ring 72. That is, the equal intermediate pressure is guided into the front surface space 96 of the thrust ring 72 and the back surface space 75 of the thrust ring. However, the present invention is not limited to this embodiment. The present invention is effective as long as the compressed refrigerant in the compression element 2 can be guided into both the front surface space and the back surface space of the thrust ring so as to satisfy a relation of F1<F2, in which F1 is an operating pressure applied from the front surface space of the thrust ring to the thrust ring, and F2 is an operating pressure applied from the back surface space to the thrust ring.

For example, a compressed refrigerant in a compression element having a pressure higher than that of a compressed refrigerant in the compression element to be guided into a back surface space may be guided into a front surface space of a thrust ring in a range of a relation of F1<F2, in which F1 is an operating pressure applied from the front surface space of the thrust ring to the thrust ring, and F2 is an operating pressure applied from the back surface space to the thrust ring. Here, there will be described one example of a sealed type scroll compressor capable of guiding the compressed refrigerant in the compression element having a pressure higher than that of the compressed refrigerant in the compression element to be guided into the back surface space into the front surface space of the thrust ring as described above, with reference to FIGS. 5 to 8. It is to be noted that in FIGS. 5 to 8, parts denoted with the same reference numerals as those of FIGS. 1 to 4 produce the same or similar effect or function, and hence the description thereof is omitted. In the present embodiment, only differences from Embodiment 1 described above will be described.

In a sealed type scroll compressor C of the present embodiment, a passage for guiding a compressed refrigerant in a compression element 2 into a back surface space 75 of a thrust ring 72 is formed separately from a passage for guiding the compressed refrigerant in the compression element 2 into a front surface space 96 of the thrust ring 72. Specifically, a orbit scroll 8 and the thrust ring 72 are provided with a communication hole 100 which connects a compression space 25 to the back surface space 75, and the communication hole 100 is the passage for guiding the compressed refrigerant in the compression element 2 into the back surface space 75 of the thrust ring 72.

The communication hole 100 is constituted of a first communication hole 101 formed in the orbit scroll 8 and a second communication hole 102 formed in the thrust ring 72. The first communication hole 101 is formed to extend in the radial direction of a mirror plate 20 of the orbit scroll 8, and includes an upper surface port 101A in the upper surface (the lap face) of the mirror plate 20 and a lower surface port 101B in the lower surface (the back surface) of the mirror plate 20. The upper surface port 101A is provided at a position connected to the compression space 25 having an intermediate pressure, and the intermediate pressure is set to a value closer to that of a suction pressure.

Figure 6:
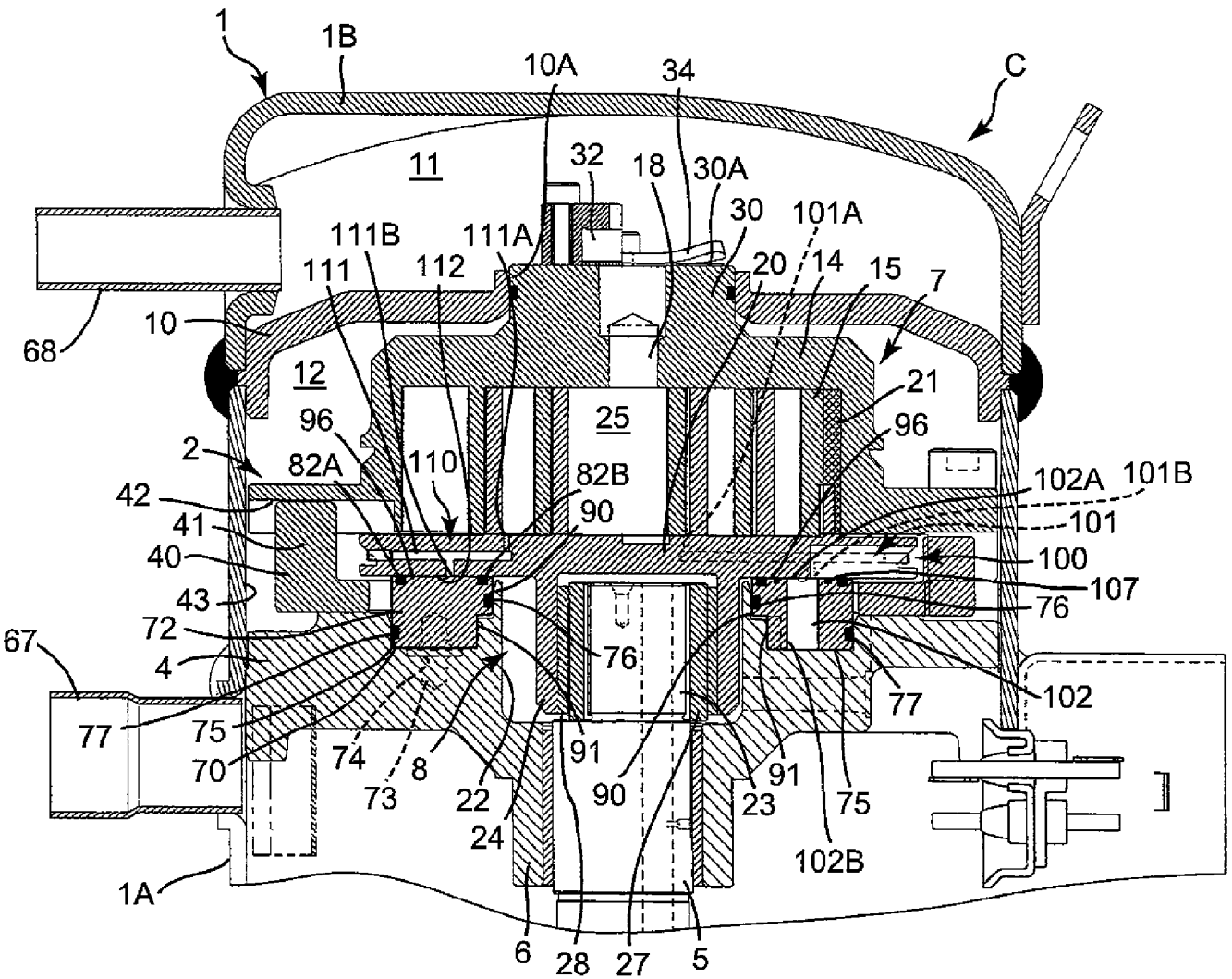
FIG. 6 is an enlarged view around a compression element of the sealed type scroll compressor of FIG. 5.

On the other hand, the second communication hole 102 is a through hole extending through the thrust ring 72 in an axial center direction (a vertical direction), and includes an upper surface port 102A formed in the upper surface of the thrust ring 72 and a lower opening 102B formed in the lower surface of the thrust ring 72 and connected to a back surface space 75. In the constitution of the present embodiment, the upper surface port 102A of the second communication hole 102 is formed at a position including the turning track of the lower surface port 101B so that when the orbit scroll 8 is revolved, the lower surface port 101B of the first communication hole 101 formed in the orbit scroll 8 constantly communicates with the upper surface port 102A of the second communication hole 102 formed in the thrust ring 72. Therefore, while the compression element 2 compresses the refrigerant, the intermediate pressure of the compression space 25 can constantly be guided into the back surface space 75, and the orbit scroll 8 can stably be pressed onto a fixed scroll 7 via the thrust ring 72. Moreover, an annular groove 105 is formed around the upper surface port 102A of the upper surface (the front surface) of the thrust ring 72, and the groove 105 is provided with a seal member 107 excellent in wear resistance (FIG. 6). In consequence, it is possible to prevent a disadvantage that the intermediate pressure guided into the back surface space 75 through the communication hole 100 enters the upper surface (the front surface space 96) of the thrust ring 72.

Furthermore, the upper surfaces (the front surfaces) of the orbit scroll 8 and the thrust ring 72 are provided with a communicating portion 110 which communicates the compression space 25 to the front surface space 96 of the thrust ring 72, and the communicating portion 110 is a passage for guiding the compressed refrigerant in the compression element 2 into the front surface space 96 of the thrust ring 72.

The communicating portion 110 is constituted of a communication hole 111 formed in the orbit scroll 8, and a groove 112 formed in the upper surface (the front surface) of the thrust ring 72. The communication hole 111 is formed to extend in the radial direction of the mirror plate 20 of the orbit scroll 8, and includes an upper surface port 111A in the upper surface (the lap face) of the mirror plate 20, and a lower surface port 111B in the lower surface (the back surface) of the mirror plate 20. The upper surface port 111A is positioned at a position which communicates with the compression space 25 having the intermediate pressure. Furthermore, the upper surface port 111A is provided at a position which communicates with compression space 25 having a pressure higher than that of the upper surface port 101A of the communication hole 100 so that the refrigerant pressure in the compression process with the high pressure is guided into the front surface space 96 of the thrust ring 72 in a range of a relation F1<F2, in which F1 is the operating pressure applied from the front surface space 96 of the thrust ring 72 to the thrust ring 72, and F2 is the operating pressure applied from the back surface space 75 to the thrust ring 72.

Figure 7:
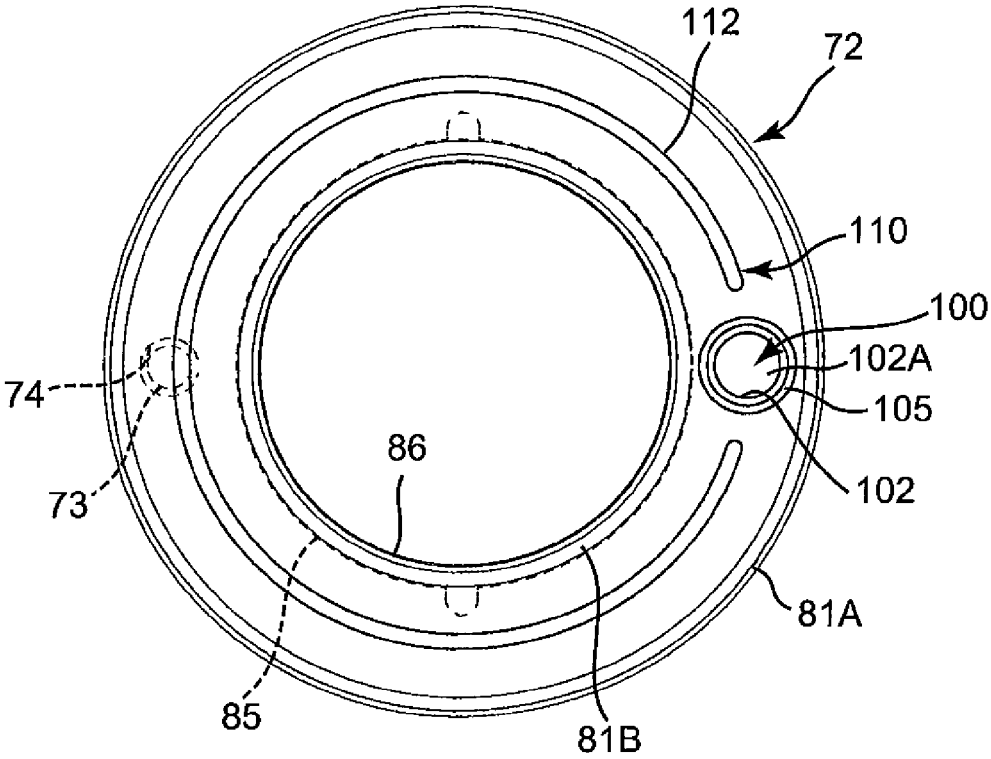
FIG. 7 is a plan view of a thrust ring of the sealed type scroll compressor of FIG. 5.
Figure 8:
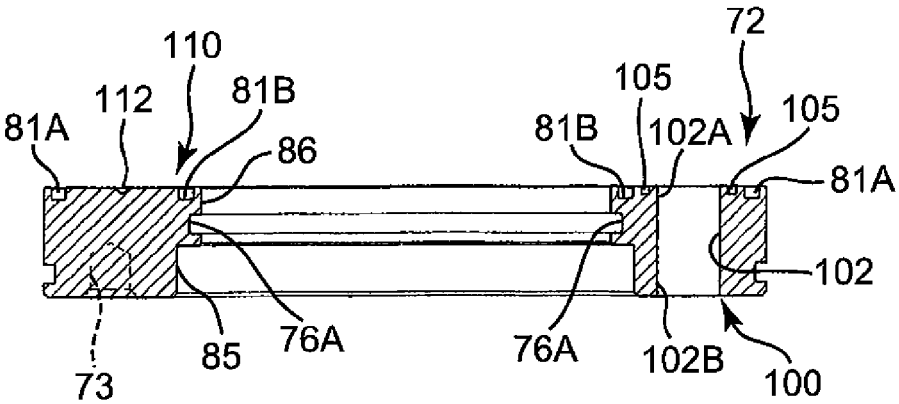
FIG. 8 is a vertical side view of the thrust ring of FIG. 7.

Moreover, as shown in FIG. 7, the groove 112 is provided in the upper surface (the front surface) of the thrust ring 72. The groove 112 is disposed between an outer groove 81A and an inner groove 81B for inserting seal members 82A, 82B, and formed into a C-shape so that the groove does not communicate with the second communication hole 102 of the communication hole 100.

In the constitution of the present embodiment, the groove 112 is formed at a position including the turning track of the lower surface port 111B so that when the orbit scroll 8 is revolved, the lower surface port 111B of the communication hole 111 formed in the orbit scroll 8 constantly communicates with the groove 112 formed in the thrust ring 72. Therefore, while the compression element 2 compresses the refrigerant, the intermediate pressure of the compression space 25 can constantly be guided into the front surface space 96.

Thus, in the same manner as in the above embodiment, the operating pressure F1 applied from the front surface space 96 of the thrust ring 72 to the thrust ring 72 and the operating pressure F2 applied from the back surface space 75 to the thrust ring 72 has the relation of F1<F2. Therefore, while sufficiently securing a pressure for pressing the orbit scroll 8 onto the fixed scroll 7, it is possible to suppress a disadvantage that the thrust ring 72 is pressed onto the orbit scroll 8 more strongly than necessary. In consequence, while preventing the leakage of the refrigerant between the fixed scroll 7 and the orbit scroll 8, a sliding loss between the thrust ring 72 and the orbit scroll 8 can be decreased.

In particular, according to the present embodiment, the compressed refrigerant in the compression element 2 having the pressure higher than that of the compressed refrigerant in the compression element 2 to be guided into the front surface space 96 can be guided into the front surface space 96 of the thrust ring 72 in the range of the relation of F1<F2, in which F1 is the operating pressure applied from the front surface space 96 of the thrust ring 72 to the thrust ring 72, and F2 is the operating pressure applied from the back surface space 75 to the thrust ring 72. Therefore, the operating pressure F1 applied from the front surface space 96 to the thrust ring 72 can be close to the operating pressure F2 applied from the back surface space 75 to the thrust ring 72.

In consequence, while keeping the function of pressing the orbit scroll 8 onto the fixed scroll 7 without any trouble, the sliding loss between the thrust ring 72 and the orbit scroll 8 can be minimized. In consequence, the efficiency of the sealed type scroll compressor C can further be improved.

What is claimed is:

1. A sealed type scroll compressor comprising: a compression element having a fixed scroll and a orbit scroll; and a motor element which drives the orbit scroll being in the orbit by its axis, a structure for supporting movably the orbit scroll in the axial direction, guiding a compressed refrigerant in a compression element into a back surface space of a thrust ring provided on the back surface of the orbit scroll, and pressing the orbit scroll onto the fixed scroll by the thrust ring while the compression element compresses the refrigerant, wherein the compressed refrigerant in the compression element is guided into a front surface space of the thrust ring, the front surface space is positioned between the back surface of the orbit scroll and the thrust ring, to provide a relation of F1<F2, in which F1 is an operating pressure applied from the front surface space of the thrust ring to the thrust ring, and F2 is an operating pressure applied from the back surface space of the thrust ring to the thrust ring, and the pressure of the entire compressed refrigerant guided into the back surface space is substantially equal to the pressure of the entire compressed refrigerant guided into the front surface space.

2. The sealed type scroll compressor according to claim 1, further comprising: a support member which supports the thrust ring; a ring groove formed in the support member to receive the thrust ring; back surface side seal members provided on the inner peripheral edge and the outer peripheral edge of the thrust ring to seal a portion between the thrust ring and the ring groove; and front surface side seal members provided on the inner peripheral side and the outer peripheral side of the surface of the thrust ring on the side of the orbit scroll to seal a portion between the thrust ring and the back surface of the orbit scroll, wherein a relation of A1>A2 is provided, in which A1 is the surface area of the thrust ring between the back surface side seal members corresponding to the back surface space of the thrust ring, and A2 is the surface area of the thrust ring between the front surface side seal members corresponding to the front surface space of the thrust ring.

3. The sealed type scroll compressor according to claim 2, wherein the compressed refrigerant in the compression element having a pressure higher than that of the compressed refrigerant in the compression element to be guided into the back surface space is guided into the front surface space of the thrust ring in a range of the relation of F1<F2, in which F1 is the operating pressure applied from the front surface space of the thrust ring to the thrust ring, and F2 is the operating pressure applied from the back surface space to the thrust ring.

* * * * *